US007850575B1

(12) United States Patent
Hsiang

(10) Patent No.: US 7,850,575 B1
(45) Date of Patent: Dec. 14, 2010

(54) TRAMPOLINE SURROUNDING NET BRACING STRUCTURE

(75) Inventor: Hua-Lu Hsiang, Taoyuan (TW)

(73) Assignee: Crowntec Fitness Mfg., Ltd., Taoyuan (TW)

( * ) Notice: Subject to any disclaimer, the term of this patent is extended or adjusted under 35 U.S.C. 154(b) by 16 days.

(21) Appl. No.: 12/555,443

(22) Filed: Sep. 8, 2009

(51) Int. Cl.
*A63B 21/00* (2006.01)

(52) U.S. Cl. ..... 482/27; 482/28

(58) Field of Classification Search ..... 482/27, 482/28; 5/223; 182/139; 267/73
See application file for complete search history.

(56) References Cited

U.S. PATENT DOCUMENTS 269,020 A * 12/1882 Sullivan ..... 267/75
4,002,065 A * 1/1977 Lardi et al. ..... 73/168
2002/0137598 A1* 9/2002 Publicover et al. ..... 482/27
2007/0111860 A1* 5/2007 Publicover ..... 482/27

FOREIGN PATENT DOCUMENTS

EP 0 107 456 A1 * 10/1983 ..... 482/27

* cited by examiner

*Primary Examiner*—Jerome Donnelly
(74) *Attorney, Agent, or Firm*—Muncy, Geissler, Olds & Lowe, PLLC

(57) ABSTRACT

A trampoline surrounding net bracing structure to provide improved connection between a trampoline and a surrounding net includes a framed bed, a plurality of supporting posts and a surrounding net. The framed bed has a jumping area to allow users to do jumping and bouncing exercise thereon. The supporting posts are located upright on the periphery of the framed bed. Each of the supporting posts has a top end equipped with a buffer means connecting to a bracing rack. The surrounding net has a bottom rim girded on the circumference of the jumping area and a top rim fastened to the bracing rack. Thus the surrounding net is stretched and surrounds the jumping area to form a confined movable space to allow the users to do jumping and bouncing exercise safer.

7 Claims, 6 Drawing Sheets

TRAMPOLINE SURROUNDING NET BRACING STRUCTURE

FIELD OF THE INVENTION

The present invention relates to a trampoline surrounding net bracing structure and particularly to a buffer structure located on a surrounding net bracing rack of a trampoline.

BACKGROUND OF THE INVENTION

Trampoline is an exercise equipment to help training of body balance, reaction ability, dynamic vision and muscle flexibility. It also provides appropriate vibration during jumping and bouncing that is helpful to brain development of young people. The trampoline was developed and introduced about two hundred years ago. Initially it was often used in circus or acrobatic performances. Later it was used by U.S. Air Force to train air force pilots. It was designated as a formal competition item in the Olympics game held in Sydney. Nowadays it becomes a popular exercise in many countries such as Europe, U.S. and Japan.

While the trampoline can bring many benefits to users, it also has potential risks to the users during exercising. For instance, inexperienced users could lose control of center of gravity during jumping and result in deviation from the center of the trampoline, and bounce outside the exercise range of the trampoline. In serious conditions, users could even fall to the ground or hit other objects outside the trampoline and get injured, bruised or sprained. To prevent such accidents and exercise injuries from happening, a trampoline equipped with a surrounding net was developed. The surrounding net forms a movable space to confine users to jump within the surrounded area. FIG. 1 shows a conventional trampoline with the surrounding net. It usually has a framed bed 100 with a jumping area 101 to allow users jumping and bouncing thereon and a plurality of supporting posts 300 located on the periphery of the framed bed 100 to hold a surrounding net 200. The surrounding net 200 has a bottom rim 202 located on the circumference of the jumping area 101 and a top rim 201 connected to a top end 301 of each supporting post 300 by means of a bracing band 400. Thus the surrounding net 200 is stretched upright and around to form the jumping area 101 to confine users within a limited movable space without the risk of bouncing outside the trampoline.

However, during jumping and bouncing exercise, the users could inadvertently or incidentally pull and drag the top rim 201 and cause damage of the surrounding net 200. As a result, the surrounding net 200 has to be replaced frequently and almost becomes a consumable supply. And periodic repair and maintenance have to be performed that incur a significant expense. To remedy the aforesaid problem, an improvement has been proposed as shown in FIG. 2. It differs from FIG. 1 by having the top rim 201 connected to a bracing rack 500. The bracing rack 500 usually is made of sturdy material such as metal. With the top rim 201 connected to and supported by the bracing rack 500, deformation and damage caused by pulling and dragging can be prevented. However, the sturdiness of the bracing rack 500 reduces the buffer resilience of the top rim 201 resulting from deformation that might otherwise take place. Users could incidentally hook the bracing rack 500 and inflict physical injury, such as on necks and arms since the lack of the elasticity of the bracing rack 500. To overcome the drawback mentioned above, some trampolines have the bracing rack 500 made from glass fibers. The glass fibers have toughness to provide sufficient support and are bendable to offer appropriate buffer to protect users from injury.

While the bracing rack 500 made from glass fibers provides more desirable characteristics, it tends to suffer from elastic fatigue after using for a period of time under frequent pulling and dragging, and irrevocable deformation occurs. Repair and displacement cost are expensive. The durability is not desirable. Hence there is still room for improvement about the bracing rack 500 of the surrounding net 200 of the trampoline.

SUMMARY OF THE INVENTION

The primary object of the present invention is to solve the problems of the conventional trampoline surrounding net bracing rack that tends to cause user injury or deform and result in decreased durability.

To achieve the foregoing object, the present invention includes a trampoline framed bed which has a jumping area to allow users jumping and bouncing thereon, a plurality of upright supporting posts fastened to the periphery of the framed bed, a buffer means fastened to the top end of each supporting post and a bracing rack fastened to the buffer means. The invention also provides a surrounding net which has a bottom rim girded on the circumference of the jumping area and a top rim fastened to the bracing rack. The structure thus formed provides a movable space in the jumping area bordered by the surrounding net. The top end of the supporting post can be bent towards the center of the jumping area to form a bend section and a distal end pointing to the jumping area and connecting to the buffer means. The buffer means can be a spring.

Compared with the conventional techniques, the invention provides many benefits, notably:

1. With the top rim of the surrounding net fastened to the bracing rack, the surrounding net is less likely to be damaged by pulling and dragging of users. Durability of the surrounding net improves, and displacement cost can be reduced.

2. The buffer means provides desired stretch to allow the bracing rack to generate buffer movement when users incidentally hook the bracing rack and the surrounding net during jumping or bouncing, thus can protect the users from injury.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
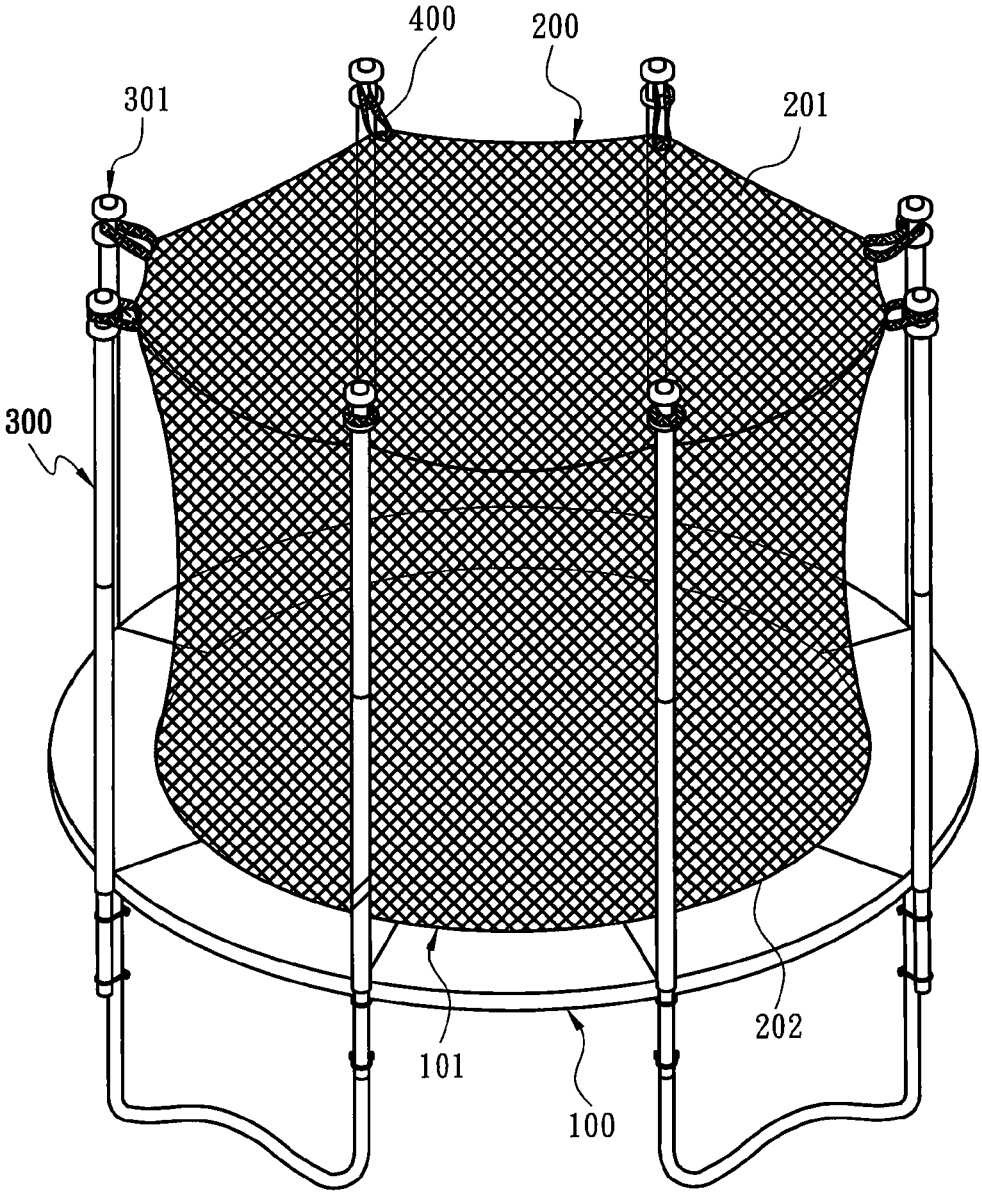
Fig. 1 PRIOR ART
FIG. 1 is a perspective view of a conventional trampoline with a surrounding net.
Figure 2:
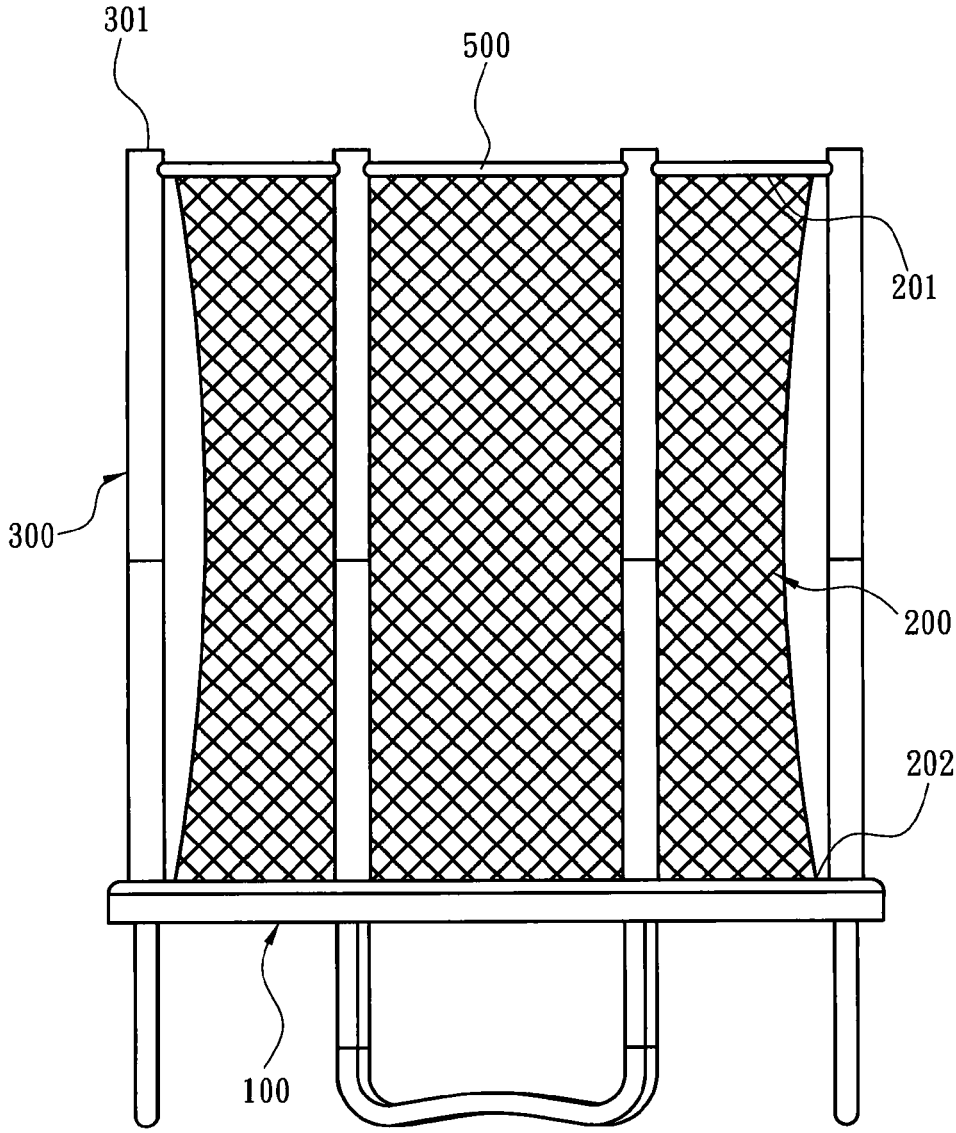
Fig. 2 PRIOR ART
FIG. 2 is a front view of a conventional trampoline with a surrounding net.
Figure 3:
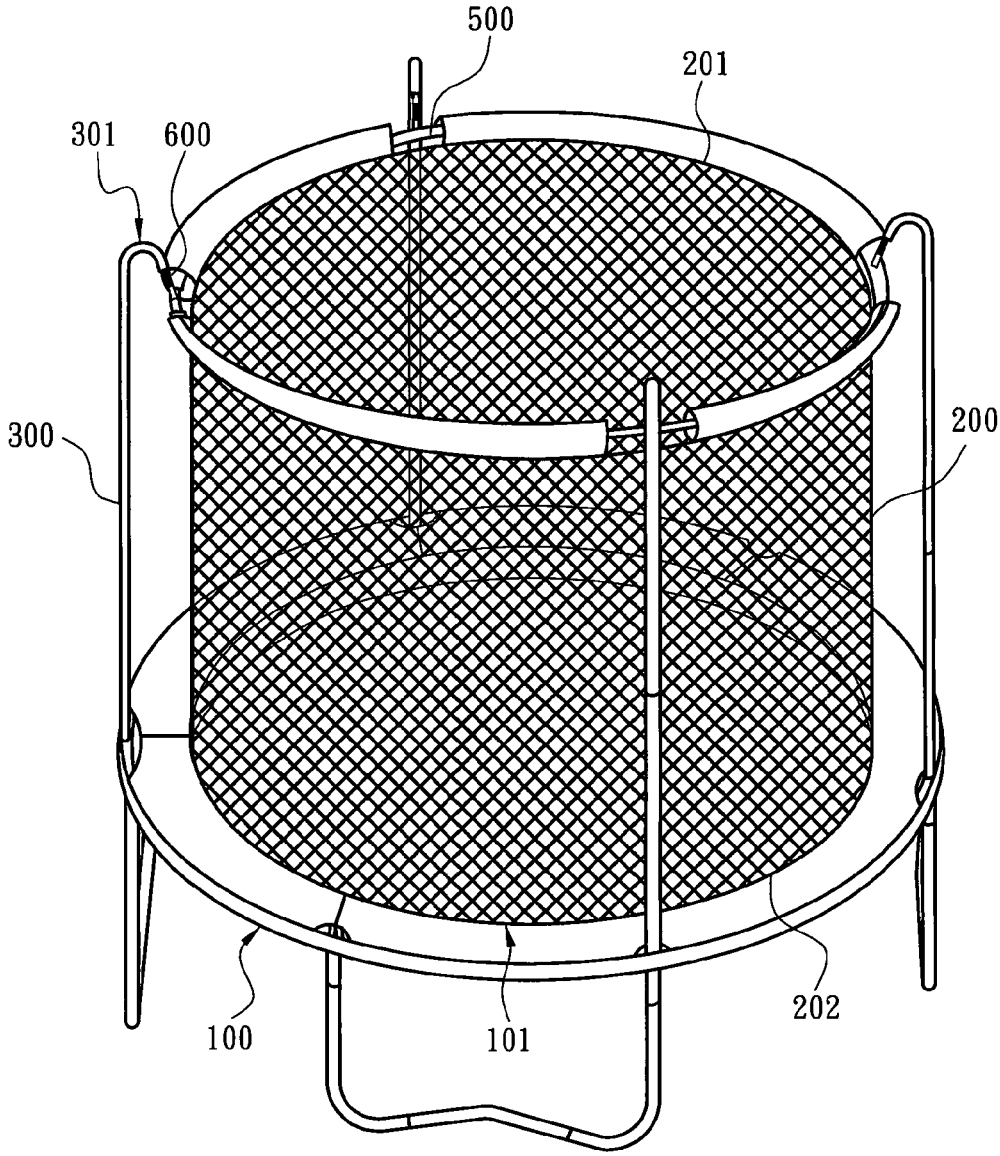
FIG. 3 is a perspective view of the invention.
Figure 4:
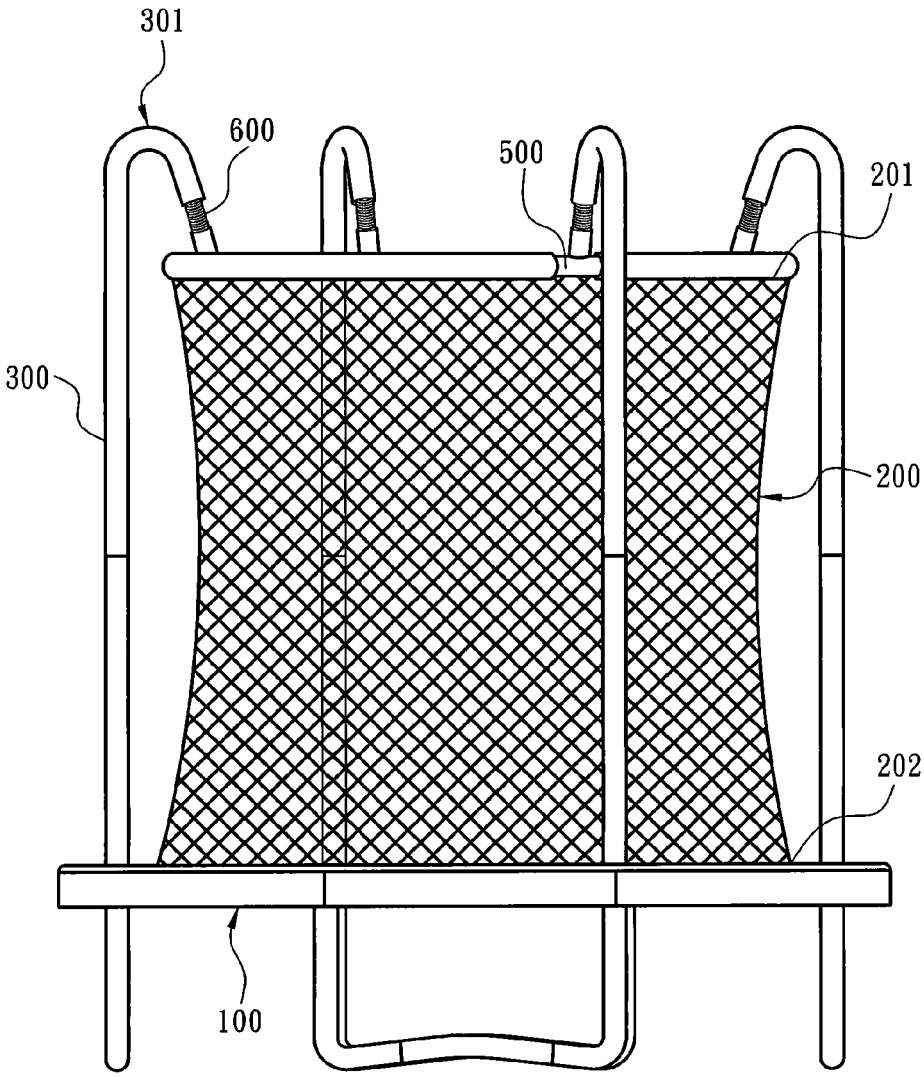
FIG. 4 is a front view of the invention.

Please refer to FIGS. 3 and 4, the trampoline surrounding net bracing structure according to the present invention includes a framed bed 100, a plurality of supporting posts 300 and a surrounding net 200. The framed bed 100 has a jumping area 101 for users to do jumping and bouncing exercise. The supporting posts 300 are located on the periphery of the framed bed 100. In an embodiment shown in the drawings, four supporting posts 300 are provided. However, it serves only for illustrative purpose and is not the limitation of the invention. The number of the supporting posts 300 may also be three, six, eight or the like. Each of the supporting posts 300 has a top end 301 equipped with a buffer means 600 to fasten to a bracing rack 500. The bracing rack 500 shown in the drawings is a circular frame formed as the same plane shape of the jumping area 101. This also serves for illustrative purpose and is not the limitation of the invention. For instance, the bracing rack 500 may also be formed in other shapes mating the jumping area 101 of different shapes, such as square, rectangular, oval or the like. The surrounding net 200 has a bottom rim 202 and top rim 201. The bottom rim 202 is formed in a shape mating the plane shape of the jumping area 101 and girded on the circumference of the jumping area 101. The top rim 201 is fastened to the bracing rack 500. Thereby the surrounding net 200 is stretched and surrounds the jumping area 101 to confine users in the jumping area 101 to do jumping and bouncing exercise safer.

Figure 5A:
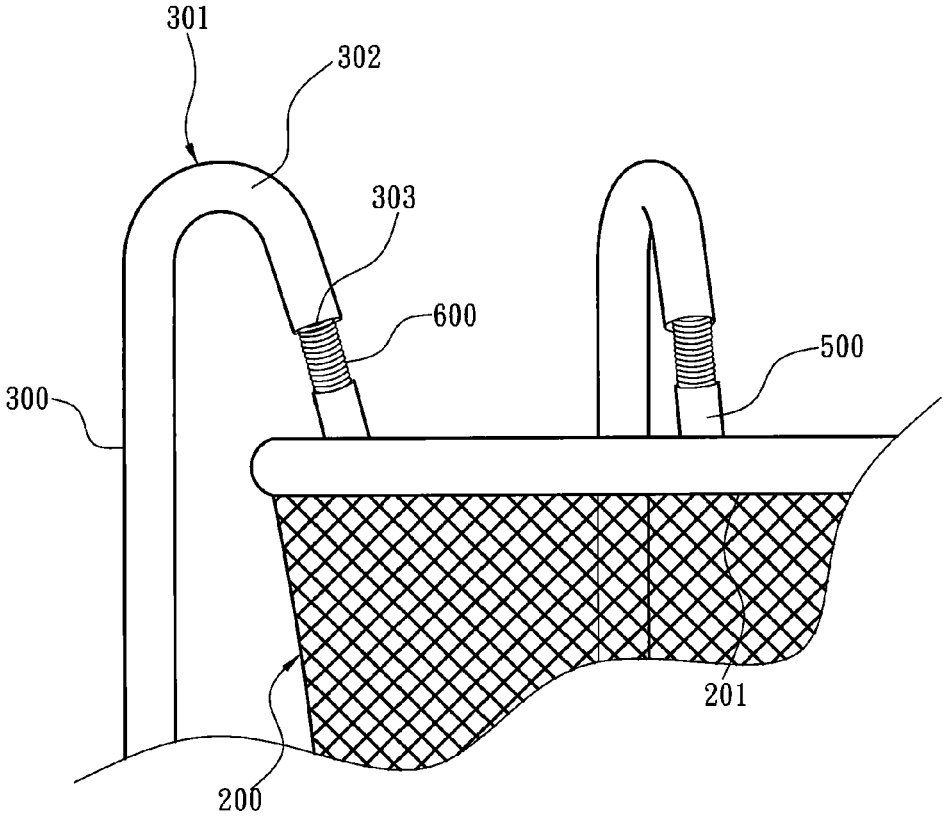
FIG. 5A is a fragmentary schematic view of the invention in a use condition.

Also referring to FIG. 5A, the buffer means 600 may be a spring to provide extensible buffer effect. Each supporting post 300 has a top end 301 bending towards the center of the jumping area 101 to form a bend section 302 and a distal end 303 pointing to the jumping area 101 and connecting to the buffer means 600. Thus when the buffer means 600 receives a vertical pressure, an optimal extensible buffer effect can be achieved.

Figure 5B:
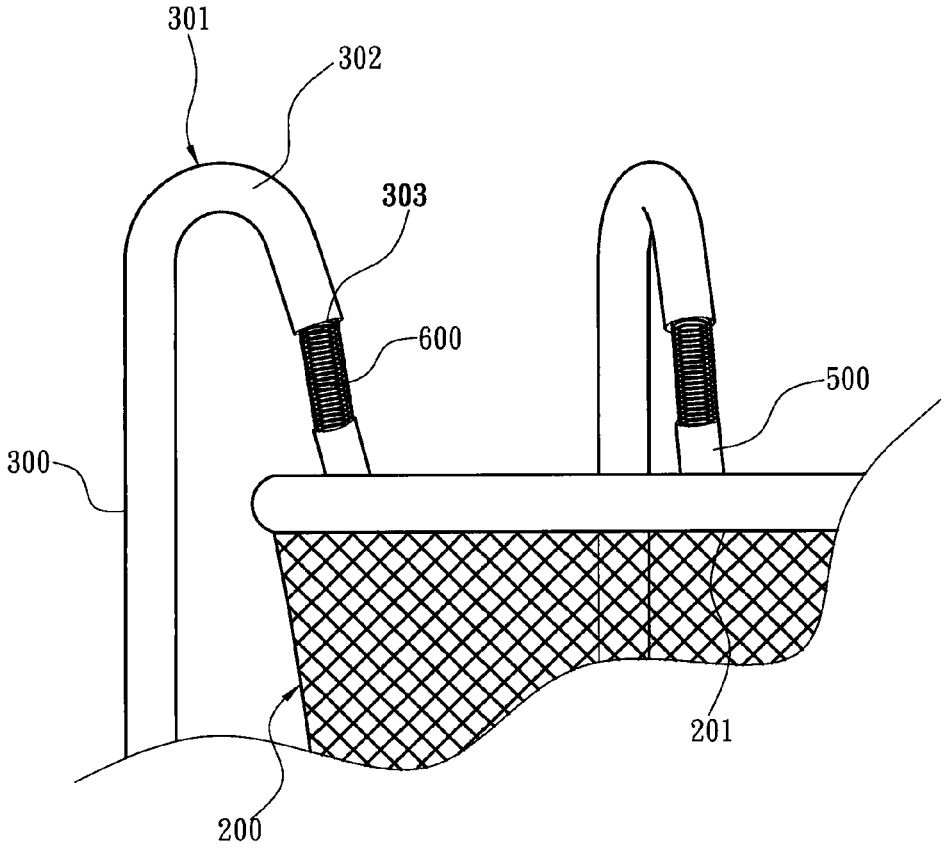
FIG. 5B is a fragmentary schematic view of the invention in another use condition.

When in use, referring to FIG. 5A with the buffer means 600 being a spring, in the event that the bracing rack 500 and surrounding net 200 are in normal use conditions without being pulled or dragged by external forces, the buffer means 600 maintains unchanged profile. Referring to FIG. 5B, in the event that the bracing rack 500 or surrounding net 200 is subject to an external stretching or pulling force and a pressure is generated, the pressure is transmitted to the buffer means 600 so that the buffer means 600 is stretched to form a buffering effect. When the stretching or pulling force of users is released from the bracing rack 500 or surrounding net 200, the pressure also is released, then the buffer means 600 is contracted and returns to its original shape. Such a structure provides a significant improvement over the conventional techniques.

While the preferred embodiment of the invention has been set forth for the purpose of disclosure, it is not the limitation of the invention. The bracing rack 500 may be made of metal, glass fibers, carbon fibers or the like. Thus modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A trampoline surrounding net bracing structure, comprising:

a framed bed having a jumping area to allow users to do jumping and bouncing exercise thereon;

a plurality of supporting posts located upright on the periphery of the framed bed, each of the supporting posts having a top end equipped with a buffer means which is fastened to a bracing rack, each top end being bent towards the center of the jumping area to form a bend section and a distal end pointing to the jumping area and connecting to the buffer means; and a surrounding net having a bottom rim girded on the circumference of the jumping area and a top rim fastened to the bracing rack.

2. The trampoline surrounding net bracing structure of claim 1, wherein the bracing rack is selectively made of metal, glass fibers or carbon fibers.

3. The trampoline surrounding net bracing structure of claim 2, wherein the buffer means is a spring.

4. The trampoline surrounding net bracing structure of claim 1, wherein the buffer means is a spring.

5. The trampoline surrounding net bracing structure of claim 1, wherein the bracing rack is selectively made of metal, glass fibers or carbon fibers.

6. The trampoline surrounding net bracing structure of claim 5, wherein the buffer means is a spring.

7. The trampoline surrounding net bracing structure of claim 1, wherein the buffer means is a spring.

* * * * *